United States Patent [19]

Ward

[11] 4,138,980

[45] Feb. 13, 1979

[54] SYSTEM FOR IMPROVING COMBUSTION IN AN INTERNAL COMBUSTION ENGINE

[76] Inventor: Michael A. V. Ward, 20 Marret Rd., Lexington, Mass. 02173

[21] Appl. No.: 853,436

[22] Filed: Nov. 21, 1977

Related U.S. Application Data

[63] Continuation-in-part of Ser. No. 496,393, Aug. 12, 1974, Pat. No. 3,934,566, and Ser. No. 622,165, Oct. 14, 1977, abandoned.

[51] Int. Cl.[2] ..... F02M 7/00; F02B 33/00

[52] U.S. Cl. ..... 123/119 E; 123/143 B; 219/10.57; 219/10.55 R; 431/2; 431/6

[58] Field of Search ..... 113/148 E, 143 B, 119 E; 219/10.55 R, 10.57; 431/2, 6; 73/116

[56] References Cited

U.S. PATENT DOCUMENTS

| | | | |
|---|---|---|---|
| 2,402,539 | 6/1946 | Eitel | 123/148 E |
| 2,617,841 | 11/1952 | Linder | 123/148 E |
| 2,876,270 | 3/1959 | Lutz | 123/148 E |
| 3,589,177 | 6/1971 | Merlo | 73/116 |
| 3,934,566 | 1/1976 | Ward | 123/119 E |

OTHER PUBLICATIONS

"The Effect of Electric Fields . . . ." Combustion, Flame 16, pp. 275–285, 1971.

*Primary Examiner*—Ronald B. Cox
*Attorney, Agent, or Firm*—Kenway & Jenney

[57] ABSTRACT

A technique for increasing the efficiency, and for decreasing the exhaust emissions, of an internal combustion type engine in which rf energy is generated at a frequency which both (a) is suitable for coupling the energy to a combusting plasma air-fuel mixture (preferably at a plasma frequency) and (b) excites at least one resonant mode of the engine's combustion chamber; so as to enhance both pre-combustion conditioning of the mixture and combustion reactions.

22 Claims, 1 Drawing Figure

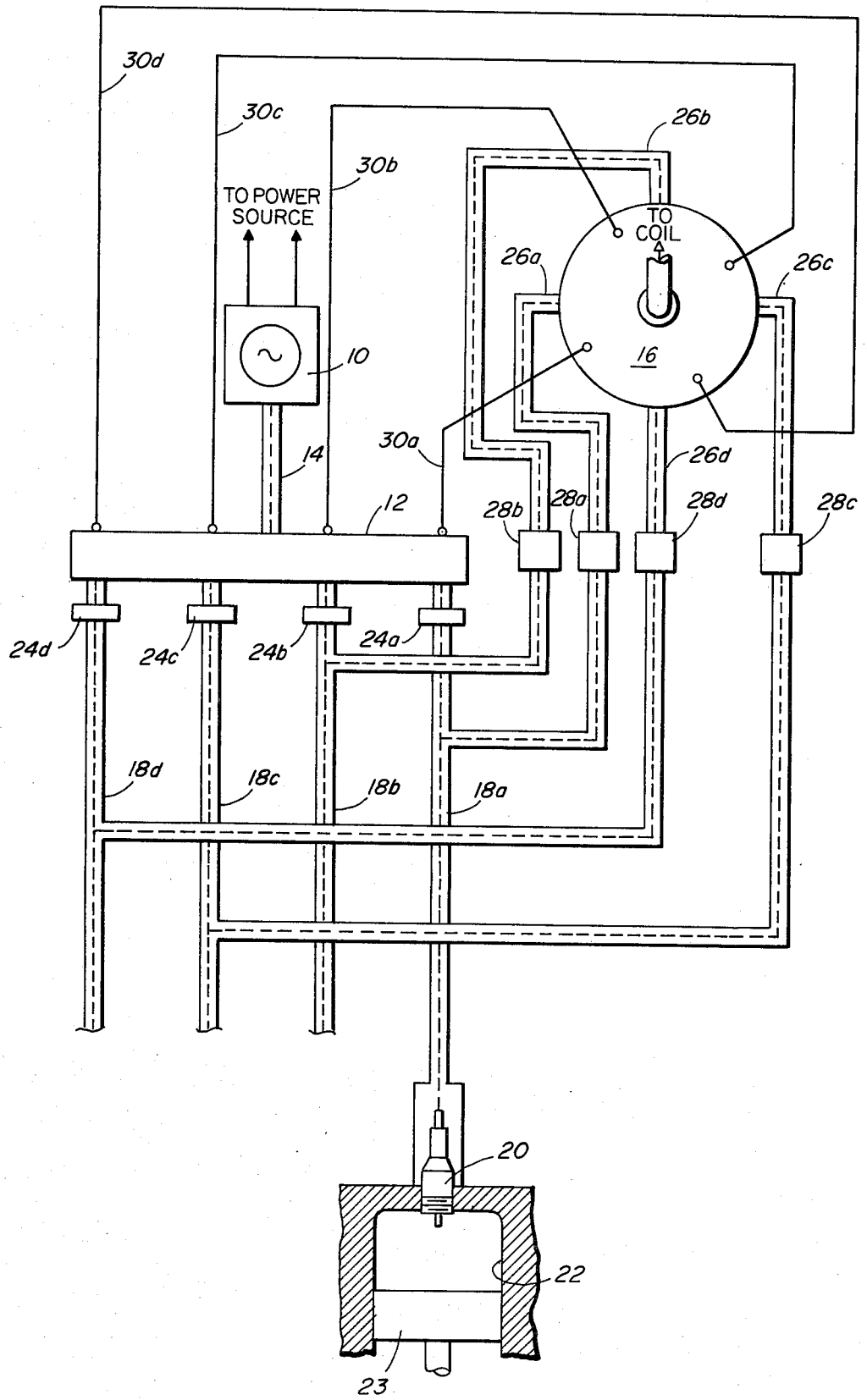
30d
30c
30b
TO POWER SOURCE
10
14
12
26b
TO COIL
26a
26c
16
30a
26d
28b
28a
28d
28c
24d
24c
24b
24a
18d
18c
18b
18a
20
22
23

SYSTEM FOR IMPROVING COMBUSTION IN AN INTERNAL COMBUSTION ENGINE

CROSS REFERENCE TO RELATED APPLICATIONS

This application is a continuation-in-part of U.S. application Ser. No. 496,393, filed Aug. 12, 1974, now issued as U.S. Pat. No. 3,934,566, issued Jan. 27, 1976, and of U.S. application Ser. No. 622,165, now abandoned filed Oct. 14, 1977, each of which is incorporated herein by reference.

BACKGROUND OF THE INVENTION

This invention pertains generally to apparatus and a method for increasing efficiency and/or decreasing exhaust emissions of an internal combustion engine.

The concern over air pollution and the dwindling of petroleum resources has resulted in legislation which has caused a shift in emphasis from powerful, high compression engines to small, low compression ones. As the degree of pollution which an automobile introduces into the air is measured in parts per mile, a smaller, lower compression engine, burning a leaner mixture (i.e., a higher ratio of air to fuel) can more readily satisfy the pollution requirements.

It is known on the one hand that the level of CO (carbon monoxide) produced by the internal combustion engine decreases as the air-fuel ratio is increased, and continues to decrease beyond the "chemically ideal" ratio of 14.7, and the decrease extends to the "lean limit", i.e., the limit at which flame speed drops to zero and at which the air-fuel mixture does not ordinarily ignite. The production of $NO_x$ (oxides of nitrogen), on the other hand, is most sensitive to the time at which the spark is fired (given in degrees before top dead center, BTDC). The production of $NO_x$ is parts per mile, jumps from approximately 1,000 to 3,000 parts when the spark timing is advanced over a 20° range. In order to reduce carbon monoxide, oxides of nitrogen and also other hydrocarbons, therefore, one must operate the internal combustion engine with an air-fuel ratio lying at the lean end of the scale, and ignite the mixture as close to TDC as possible. The difficulties associated with these conditions are two-fold: firstly, as the mixture is made leaner, it will become increasingly more difficult to ignite with the spark, since the spark constitutes a constant external energy source of approximately 0.1 joule/spark energy capacity, and secondly, the resultant drop in flame speed along with spark timing near TDC will result in late combustion of the mixture and hence reduced efficiency as well as increased discharge of unburnt hydrocarbons through the exhaust. (On the other hand it is known that in order to increase engine efficiency as well as decrease exhaust emissions it is very desirable to ignite and sustain combustion of a lean mixture in an internal combustion engine.)

Among the prior art references are references teaching the utilization of microwave energy to study piston motion and combustion processes in piston-type internal combustion engines. Examples of such prior art references are Merlo U.S. Pat. No. 3,589,177 and Merlo U.S. Pat. No. 3,703,825. These references, however, are concerned with obtaining resonances in an engine cylinder between the engine cylinder head, cylinder wall, and the piston face so that the motion of the piston and the constituents of the cylinder can be analyzed. Since these references have a diagnostic procedure as their object, it will be appreciated that very low power microwave energy is employed in order to not substantially perturb the system under study.

In view of the foregoing it is a principal object of the present invention to provide a system which increases the efficiency, and also reduces the exhaust emissions of an internal combustion engine, which can be installed in existing internal combustion engines, with a minimum of engine modification, and is relatively cheap and easy to manufacture and install, and requires relatively low power in operation.

Other objects are to enhance combustion and increase flame speed in the combustion chambers of internal combustion engines and to provide an improved ignition support system for an internal combustion engine.

Other objects and advantages of the invention will become apparent from the following description of particular preferred embodiments of the invention when read in conjunction with the accompanying drawings.

SUMMARY OF THE INVENTION

Briefly, the invention features a system for use with an internal combustion engine having a combustion chamber of predetermined shape, means for producing a combustible mixture therein, and means for igniting the mixture. The system comprises means for generating, and for conducting to the combustion chamber at substantial power levels, electromagnetic energy at an operating frequency, $f_o$, which (a) is of the order of the plasma frequency of a species of charged particles of the mixture, and (b) excites at least one resonant mode of the combustion chamber continuously during the conduction of energy to the combustion chamber. Preferably, for a combustion chamber that is cylindrical in shape, $f_o$ is such that a cylindrical resonant cavity mode of the type $TM_{lm0}$ is continuously excited, whereby resonance can be maintained in said combustion chamber independent of its length; the cylindrical resonant cavity mode is the $TM_{010}$ mode; and the internal combustion engine is a piston engine having a plurality of combustion chambers with a moveable piston in each and the means for igniting comprise a spark plug for each chamber, each spark plug also connected to deliver the energy at frequency $f_o$ to its associated combustion chamber.

BRIEF DESCRIPTION OF THE DRAWING

Other objects, features and advantages of the invention will appear from the description below, taken together with the accompanying drawing which is a generally schematic illustration of a four cylinder piston engine incorporating the features of the present invention.

DESCRIPTION OF PARTICULAR PREFERRED EMBODIMENTS

The present invention is concerned with coupling microwave energy to igniting and/or combusting air-fuel mixtures in internal combustion engines so as to enhance the breakdown processes and to increase the speed of combustion reactions.

In order to more effectively couple microwave energy to the flame plasma (and spark plasma where applicable), it is proposed to maintain high electric fields in the vicinity of the flame plasma. It has been realized that this can be accomplished quite easily by operating at electromagnetic wave frequencies with corresponding wavelengths of the order of, and less than, the dimensions of the combustion chamber, where the chamber is constructed of electrically conductive material.

Typical combustion chamber dimensions lie in the 1 cm to 1 meter range. Frequencies corresponding to this length range lie in the $3 \times 10^8$ Hz to $3 \times 10^{10}$ Hz range. Hence, since wavelengths should be of the order of and less than the 1 cm to 1 meter range, a practical working frequency range for energy supplied to the combustion chamber is $10^8$ Hz to $10^{12}$ Hz.

Another criterion for effective coupling of microwave energy to flame plasmas is based on the realization that a plasma responds differently at different frequencies. Generally speaking, when the angular electron plasma frequency is of the order of (i.e., within one order of magnitude) the electron neutral collision frequency, one obtains optimum coupling of microwave energy to the plasma by operating at a frequency of the order of the plasma frequency. The angular electron plasma frequency is defined by $$W_p^2 = N_e e^2/m_e \epsilon_o,$$

where $N_e$ and $m_e$ are the electron number density and mass, respectively; e is the electronic charge; and $\epsilon_o$ is the dielectric constant of free space.

According to the present invention, it has been realised that the electron plasma frequency $f_p$ of electrons in hydrocarbon-air flames at atmospheric pressures where $f_p = W_p/2\pi$, is of the order of $10^{10}$Hz, a number well in the frequency range that was specified above as being ideal for more effective coupling to flames in engines. Hence, a metallic combustion chamber is an ideal environment for coupling of microwaves to hydrocarbon flame plasmas.

For combustion chambers of arbitrary shape or changing shape, one can optimize coupling of the microwave energy by operating at frequencies with corresponding wavelengths smaller than the chamber dimensions. In this way microwave energy can be radiated out to the flame, and also one or more standing waves, or cavity modes, can be set up which permits the maintenance of continuous high electric fields. Generally speaking, the chamber acts as a storage system of electrical field energy, and an equilibrium is maintained between the microwave power that is absorbed by the flame plasma (and walls) and that which is fed to the chamber by the microwave source. In the chamber, the power stored will be many times that dissipated in the flame plasma (and walls), and is directly related to the Quality Factor (Q) of the chamber, where Q is:

$$Q = \frac{2\pi f \text{(time-average energy stored in system)}}{\text{energy loss per second in system}}$$

For combustion chambers with some degree of symmetry, one can attempt to excite one particular cavity mode. This may be advantageous for at least two reasons:

1. It will allow one to predetermine the electric field configuration in the cavity and hence pick that particular mode which optimizes coupling of microwave energy to the flame plasma; and 2. It will allow one to operate at a lower microwave frequency, which may permit using power microwave solid state sources. These are currently more readily available at frequencies below $5 \times 10^9$ Hz. Microwave solid state sources are typically powered by low voltage DC, such as 12v DC (the standard automobile voltage).

For chambers with cylindrical symmetry (or even merely circular symmetry, such as combustion chambers of jet engines, gas turbines, etc.), one can excite cylindrical transverse magnetic $TM_{l,m,n}$ modes or transverse electric $TE_{l,m,n}$ modes, where the subscripts l,m,n denote the number of standing waves (half wavelengths) in the angular direction, radial direction, and axial direction, respectively. The electromagnetic field components associated with these various modes are known to those skilled in microwave engineering. For example, the transverse magnetic mode $TM_{0m0}$ has the following non-zero electromagnetic field components: $E_z(r)$, $H\theta(r)$, where r, $\theta$, z are the radial, angular and axial position variables, $E_z$ is the axial electric field, $H_\theta$ is the angular magnetic field. $E_z(r)$, $H_\theta(r)$ vary as a function of radius but are constant in the angular and axial directions. The $TM_{0m0}$ mode will have $(2m-1)$ half wavelength variations in the radial direction.

The $TM_{lm0}$ modes are particularly interesting in that they can be continuously excited and maintained, in a conventional cylindrical piston-type engine with a fixed frequency of electromagnetic energy while the engine is running, since the mode does not depend upon the axial displacement. Only the Q of the combustion chamber will vary significantly with piston position; the resonant frequency for $TM_{lm0}$ modes, for practical purposes, remains constant.

As is known, there is a spark plasma associated with the high voltage breakdown fields generated by the spark plugs of a conventional piston-type internal combustion engine. In order to optimize coupling of microwave energy to the spark plasma (as well as flame plasma), one can ground the spark to the piston face when firing occurs near "top dead center" in the piston's cycle. In this way, the larger resonant cavity chamber electric fields (the $E_z(r)$ field) are available and can be dumped into the spark plasma (with obvious lowering of cavity Q) to increase both the spark magnitude and duration. As the microwave-enhanced DC spark dissipates, the resonant field $E_z(r)$ builds up again (cavity Q increases) and microwave energy is transferred to the initial flame plasma to maintain lean mixture flame propagation and increase flame speed.

For illustrative purposes, there is shown in the drawing a schematic illustration of a four-cylinder piston-type internal combustion engine incorporating features of the present invention. Referring now to the drawing, there is shown a high frequency power oscillator or source 10, which may be one of many commercial CW magnetrons. The source 10 may be powered by an automotive power system (not shown). A remotely actuated coaxial relay switch 12 is coupled to the source 10 via coaxial cable 14. A distributor 16 provides the timing for introducing the DC electrical energy into each cylinder.

Coaxial cables 18*a–d* electrically couple the output of switch 12 with spark plugs 20. (To simplify the drawing only a single spark plug 20, cylinder 22, and piston 23 are shown.) Suitable spark plug designs for receiving, and for conveying to the combustion chamber 22, high frequency energy are described in the above-mentioned U.S. Pat. No. 3,934,566. High voltage DC blocks 24*a–d* are provided in the coaxial lines 18*a–d* between the sources 10 and the spark plugs 20 to insure that high voltage does not reach the microwave sources 10, while allowing the microwave energy to propagate with small reflection. The distributor 16, which distributes the DC high voltage to each cylinder, is coupled via coaxial cables 26*a–d* to cables 18*a–d* above the spark plugs. Power high frequency filters 28*a–d* are provided in cables 26*a–d* between distributor 16 and cables 18*a–d* to insure that high frequency power does not reach the distributor and the environment, but are chosen to carry without breakdown the high voltage DC. Lines 30*a–d* couple the switch 12 to the distributor 16, which provides the timing for the operation of switch 12.

Typically, the cylindrical combustion chamber 22 will have dimensions dictated by conventional design criteria for internal combustion engines. For the particular combustion chamber dimensions of any particular engine, the high frequency chosen is one which excites at least one of the resonant cylindrical cavity modes, as discussed above. As also discussed above, if a $TM_{lm0}$ mode is to be excited, the movement of the piston 23 will not "de-tune" the cylindrical cavity 22 despite its reciprocating motion which continuously changes the length of the cylindrical cavity. Thus, higher levels of electric field can be maintained within the cavity 22 than would be the case if no resonant mode were being excited. These higher field levels, of course, indicate that more high frequency energy is available in the combustion chamber for coupling to the plasma in the flame front of a combusting air-fuel mixture.

Substantial levels of electric field intensity are important to successful operation of the present invention. Indeed, the microwave energy delivered to the combustion chamber should be at a power level sufficient to enhance combustion reactions. As is explained in greater detail below, it is presently believed that a power level of the order of 100 watts (i.e., the range 10 watts $\leqq$ power level $\leqq$ 1000 watts) is important. This range of power level is derived from the properties of combustion in internal combustion (IC) engines, from the properties of the flame plasma, from the energy requirement to severely perturb the flame front electron plasma, and from the work of H. C. Jaggers and A. von Engel, "The Effect of Electric Fields on the Burning Velocity of Various Flames", *Combustion & Flame,* 16, 275–285 (1971). As a matter of definition, a severe perturbation of the flame front electron plasma is one that produces a rise in flame front electron temperature $\Delta T_e$ equal to or greater than the initial electron temperature $T_e^i$, where $T_e^i$ is typically 2000° to 4000° K.

$$\Delta T_e \geqq T_e^i \tag{1}$$

The necessity for severely perturbing the electron plasma in order to enhance combustion reactions is based on the realization that only when electron temperatures are raised from the 2000° K. to 4000° K. range to the 5000° K. to 10,000° K. range do in-elastic electron-molecule collisions become important, and the electrons are capable of internally exciting substantial numbers of molecules (at the flame front).

Given this background, one can determine the power levels that are required to severely perturb flame front electrons in IC engines. However, it must be recognized that the required power levels can only be specified within a range, and one can only speak of an order of magnitude power level (order of 100 watts, as will be shown) for the following reasons:

1. The flame front plasma properties, and specifically the plasma frequency (or electron density) of a lean atmospheric hydrocarbon-air laminar flame, is believed to lie in the range $10^9 \leqq f_p \leqq 10^{10}$ Hz and a more precise value has not been determined yet.

2. Given the differing conditions in an IC engine (principally higher pressure and turbulent flame propagation), uncertainty will be introduced in extrapolation of the laminar atmospheric flame parameters to those of an IC engine.

3. The required power levels to enhance combustion will vary depending on the extent to which enhancement is desired. If enhancement of the weak, initial flame front only is desired, then power levels in the range 10 to 100 watts are required, while if enhancement of the entire combustion is required, then power levels in the 100 to 1000 watts will be required (for moderate size combustors as found in IC engines).

The general case can now be worked out. An expression for the increase in electron energy $k \cdot \Delta T_e$ (k is Boltzman's constant) is given by:

$$k \cdot \Delta T_e = \frac{2}{3} \; \frac{\epsilon_o W_p^2 / V_e}{N_e \sum_i r_i V_{ei}} \cdot E^2 \tag{2}$$

$V_e$ is the collision frequency between electrons and neutral particles;

$V_{ei}$ is the collision frequency between electrons and neutral particle species "i";

$r_i$ is the fractional loss of electron energy per collision when an electron collides with a neutral particle of species "i";

W is the angular operating (microwave) frequency.

Since the electric field is related to the input power P according to:

$$E^2 \, \alpha \, P$$

it follows that the previous expression is the required relation between the resulting heating of the flame front plasma and the input power level P to the flame front.

However, this is only part of the picture, since the electric field that can be maintained in the combustion chamber depends strongly on the electrical properties of the flame front plasma. If, for example, we take the example of a typical automobile combustion chamber, which is excited in the $TM_{010}$ mode, then we can write:

$$E_o^2 = 8/\pi\epsilon_o W_{dC}^2 \cdot P \cdot Q \text{ (volts/meter)}^2 \tag{3}$$

where $E_o$ is the electric field at the center of the cylinder (in the region of the initial flame front); d is the height of combustion chamber; and C is the radius of combustion chamber. Substituting for $\pi$, $\epsilon_o$, W, and typical values of d, C, this reduces to:

$$E_o^2 = 100 \cdot P \cdot Q \text{ volts}^2/\text{cm}^2 \tag{4}$$

where P is in watts.

The effect of the flame plasma on the electric field is contained in Q. If the plasma is tenuous, Q will be high; if it is dense, Q will be low. To obtain a constant $E_o^2$, and hence a constant $\Delta T_e$, the power level must be made inversely proportional to Q.

Therefore, on this basis alone, it is apparent that P must be specified within a range of values. Since the parameters $r_i$, $V_{ei}$, $V_e$ are relatively insensitive to the flame properties (assuming an average neutral density Nn), we can substitute typical values for these and write:

$$k \cdot \Delta T_e = \frac{2}{5} \cdot \frac{P\,\overline{Q}}{N_e \cdot V} \cdot 10^{-8} \text{ joules} \tag{5a}$$

V is the cavity (combustion chamber) volume where $V_{ei}$, $V_e$ corresponding to a three-atmosphere density is used.

$$\overline{Q} \simeq .25 \cdot \frac{C^2}{(b^2 - a^2)} \tag{5b}$$

a is the inner radius of flame front;
b is the outer radius of flame front
where $(b^2-a^2)$ is proportional to the flame volume.

$$k \cdot \Delta T_e \simeq \left(\frac{C^2}{V} \cdot 10^{-9}\right) \cdot \frac{P}{N_e \cdot (b^2 - a^2)} \text{ joules} \tag{6}$$

If the required power level is defined as that which will produce $k \cdot \Delta T_e$ equal to $2 \cdot kT_e^i$, then we can write:

$$P = \left(\frac{V \cdot 10^9}{C^2}\right) \cdot N_e \cdot (b^2 - a^2) \cdot 2kT_e^i \text{ watts} \tag{7}$$

which is the desired relation.

Although this equation contains features specific to an automobile combustion chamber excited in the $TM_{010}$ mode, relatively small errors will be introduced if it is applied to other combustors. We can take this expression as defining, for a typical combustion chamber, the power level necessary to enhance combustion reactions.

As an example, consider:

$$C = 4 \text{ cms}$$
$$d = 1 \text{ cm}$$
$$b \simeq a = 1 \text{ cm}$$
$$b - a = 0.1 \text{ cm} \tag{8}$$

Before substituting values, we note that the previous result can be written as:

$$P = 4\pi b \cdot d \cdot (b-a) \cdot N_e \cdot (kT_e^i) \cdot 10^9 \text{ watts} \tag{9}$$

If $N_e$ is expressed in units of electrons/cm$^3$, then b, d, (b−a) should be expressed in cms.

$$P = 4\pi N_e \cdot (kT_e^i) \cdot 10^8 \text{ watts}$$

or in more practical units $$P = 20 \cdot N_e \cdot 10^{-12} \cdot T_e^i \text{ watts} \tag{10}$$

where $N_e \sim$ electrons/cm$^3$ $T_e \sim$ thousands of °K

For example, if $N_e \simeq 10^{12}$/cm$^3$, $T_e^i \simeq 3{,}000°$ K., then:

$P = 60$ watts

Equations (9) and (10) can be taken as approximate definitions of the power that must be absorbed by the flame front electrons in order to enhance combustion reactions. For automobile engines, (10) suffices, while for other combustors such as jet engines with larger flame fronts, (9) gives the approximate expression.

In order to arrive at a practical range of values, we can take as the range of $N_e$ expected to be encountered in automobile applications as:

$$3 \cdot 10^{11} \leqq N_e \leqq 3 \cdot 10^{13}$$

which according to (10) leads to:

$$6 \cdot T_e^i \leqq P \leqq 600 \cdot T_e^i$$

and if $T_e \simeq 1{,}800°$ K., then $$10 \leqq P \leqq 1{,}000 \text{ watts}$$

consistent with the original assumption.

While particular preferred embodiments of the present invention have been described in detail herein and illustrated in the accompanying drawing, other embodiments are within the scope of the invention and the following claims.

I claim:

1. A system for use with an internal combustion engine having a combustion chamber of predetermined shape, means for producing a combustible mixture therein, and means for igniting said mixture, the system comprising means for generating, and for conducting to said combustion chamber, electromagnetic energy at an operating frequency, $f_o$, which
   a. is of the order of the plasma frequency of a species of charged particles of said mixture, and
   b. excites at least one resonant mode of said combustion chamber continuously during the conduction of said energy to said combustion chamber;
   and at a power level sufficient to enhance combustion reactions.

2. The system of claim 1 wherein said combustion chamber possesses circular symmetry and said frequency $f_o$ is such that at least one waveguide resonant combustion chamber mode is continuously excited during combustion, thereby enabling large electric fields to be maintained in the region of combustion in said combustion chamber.

3. The system of claim 2 wherein said combustion chamber is cylindrical in shape and at least one cylindrical waveguide resonant combustion chamber mode is continuously excited during combustion.

4. The system of claim 3 wherein said combustion chamber is a jet engine combustion chamber.

5. The system of claim 3 wherein said combustion chamber is a gas turbine combustion chamber.

6. The system of claim 1 wherein said combustion chamber is cylindrical in shape and wherein said operating frequency, $f_o$, is such that a cylindrical resonant cavity mode of the type $TM_{lm0}$ is continuously excited during said conduction of electromagnetic energy to said combustion chamber, whereby resonance can be maintained in said combustion chamber independent of its length.

7. The system of claim 6 wherein said internal combustion engine is a piston engine having a plurality of said combustion chambers with a moveable piston in each, said electromagnetic energy being conducted to each of said combustion chambers.

8. The system of claim 6 wherein said cylindrical resonant cavity mode is the $TM_{010}$ mode.

9. The system of claim 8 wherein said internal combustion engine is a piston engine having a plurality of said combustion chambers with a moveable piston in each, said electromagnetic energy being conducted to each of said combustion chambers.

10. The system of claim 7 wherein said means for igniting said mixture comprise a spark plug having a central conductor for generating high voltage breakdown fields, said breakdown fields being produced between the tip of said central conductor and the surface of the associated piston facing the spark plug.

11. The system of claim 10 wherein said frequency, $f_o$, is such that the particular $TM_{lm0}$ mode which is excited has its maximum electric field component in the vicinity of the region where said high voltage breakdown fields are produced, so as to enhance the breakdown and combustion processes.

12. The system of claim 11 wherein said means for generating and for conducting to said combustion chamber electromagnetic energy at an operating frequency, $f_o$, comprise a microwave source coupled to said spark plug.

13. In a system for use with an internal combustion engine having a cylindrical combustion chamber and means for producing a combustible mixture therein, the system comprising an energy source means for generating rf electromagnetic energy, where rf energy is energy having a frequency in the range of about $10^8$ Hz to about $10^{12}$ Hz, and for generating high voltage breakdown fields, and means for conducting said rf energy and said high voltage breakdown fields to said chamber to precondition said mixture for combustion, ignite said mixture, and enhance combustion reactions, the improvement wherein energy source generates rf electromagnetic energy at a frequency such that one of the $TM_{lm0}$ cylindrical resonant cavity modes is continuously excited when said rf electromagnetic energy is conducted to said chamber.

14. The system of claim 13 wherein said cylindrical resonant cavity mode is the $TM_{010}$ mode.

15. The system of claim 13 wherein said internal combustion engine is a piston engine and said means for generating high voltage breakdown fields comprise the central conductor of a spark plug, said breakdown fields being produced between the tip of said central conductor and the surface of the associated piston facing said spark plug.

16. The system of claim 15 wherein said rf energy is conducted to said chamber through said spark plug.

17. The system of claim 15 wherein said energy source generates electromagnetic energy at a frequency such that the particular $TM_{lm0}$ mode which is excited has its maximum electric field component in the vicinity of the region where said high voltage breakdown fields are produced, thereby enhancing the breakdown and combustion processes.

18. The system of claim 17 wherein said internal combustion engine has a plurality of said combustion chambers and associated pistons, said electromagnetic energy being conducted to each of said combustion chambers.

19. The system of claim 18 wherein said means for generating high voltage breakdown fields comprise the central conductor of a spark plug, and said rf energy is conducted to said chamber through said spark plug.

20. The method of operating an internal combustion engine comprising at least one generally cylindrical combustion chamber, the method comprising supplying to each said combustion chamber continuously during ignition and combustion therein electromagnetic energy at a power level sufficient to enhance combustion reactions and at an operating frequency, $f_o$, which (a) is of the order of the plasma frequency of a species of charged particles of the combustion in the combustion chamber, and (b) excites at least one resonant mode of said combustion chamber continuously during the conduction of said electromagnetic energy to said combustion chamber.

21. The method of claim 20 wherein a cylindrical resonant cavity mode of the type $TM_{lm0}$ is continuously excited during said conduction of electromagnetic energy to said combustion chamber.

22. The method of claim 21 wherein said cylindrical resonant cavity is the $TM_{0m0}$ mode.

* * * * *